US006524082B2

(12) United States Patent
Morita et al.

(10) Patent No.: US 6,524,082 B2
(45) Date of Patent: Feb. 25, 2003

(54) ELECTRIC COMPRESSOR

(75) Inventors: Katsuyuki Morita, Kariya (JP); Shoichi Ieoka, Kariya (JP); Tatsuo Ogawa, Kariya (JP); Hirohito Hayashi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/804,219

(22) Filed: Mar. 12, 2001

(65) Prior Publication Data

US 2001/0022939 A1 Sep. 20, 2001

(30) Foreign Application Priority Data

Mar. 17, 2000 (JP) ..... 2000-075734

(51) Int. Cl.[7] ..... F04B 39/06

(52) U.S. Cl. ..... 417/366; 417/369; 417/371; 417/423.7; 310/52; 310/59

(58) Field of Search ..... 417/366, 369, 417/370, 371, 410.3, 423.7, 423.17; 310/52–59, 64, 71, 89

(56) References Cited

U.S. PATENT DOCUMENTS 3,790,311 A * 2/1974 Butts et al. ..... 417/410
4,895,005 A * 1/1990 Norbeck et al. ..... 310/54
5,714,806 A * 2/1998 Goto et al. ..... 307/10.1
5,962,996 A * 10/1999 Goto et al. ..... 318/4
6,041,609 A 3/2000 Hornsleth et al. ..... 62/259.2
6,201,365 B1 * 3/2001 Hara et al. ..... 310/54
6,234,768 B1 * 5/2001 Harakawa et al. ..... 417/366
2001/0012489 A1 * 8/2001 Harakawa et al. ..... 417/366

FOREIGN PATENT DOCUMENTS

JP S62-12471 1/1987 ..... F25D/1/00
JP S62-19535 2/1987 ..... F24F/5/00
JP H4-80554 3/1992 ..... F25B/1/00
JP 4-80554 3/1992 ..... F25B/1/00
JP 06099745 A * 4/1994 ..... 310/64
JP 8-14709 1/1996 ..... F25B/43/00

OTHER PUBLICATIONS

Ashland Electric, 1998, Ashland Electric Products, 6 pages.*

* cited by examiner

*Primary Examiner*—Charles G. Freay
*Assistant Examiner*—J. F Belena
(74) *Attorney, Agent, or Firm*—Morgan & Finnegan, LLP

(57) ABSTRACT

An electric compressor includes a compression mechanism, an electric motor and a housing. The compression mechanism draws, compresses and discharges refrigerant gas. The electric motor drives the compression mechanism. The housing accommodates the compression mechanism and the electric motor. A heat sink extends from the housing. An inverter is located in the housing. The inverter powers the electric motor. A heat sink cools the inverter. The heat sink is cooled by refrigerant gas. The heat generated by the inverter is therefore effectively reduced.

7 Claims, 2 Drawing Sheets

ELECTRIC COMPRESSOR

BACKGROUND OF THE INVENTION

The present invention relates to an electric compressor that has a power semiconductor module.

A typical electric motor used in an electric compressor is controlled by a power semiconductor module such as an inverter. When the compressor is driven, a great magnitude of electric current is supplied to the electric motor through the power semiconductor module. The power semiconductor module performs frequent switching, which generates a great amount of heat. It is therefore necessary to cool the power semiconductor module so that the module function properly.

A power semiconductor module may be cooled either by the outside air or by refrigerant that cools the compressor. A module that is cooled by the outside air has radiator fins or a fan to send air to the module.

The electric compressor disclosed in Japanese Unexamined Patent Publication No. 4-80554 has a power semiconductor module that is cooled by refrigerant. The module is attached to the circumferential surface of the housing of a compressor and is located between the compressing mechanism and the electric motor of the compressor. Heat generated by the module is absorbed by the housing. In the apparatus disclosed in Japanese Unexamined Patent Publication No. 8-14709, a power semiconductor module is attached to an accumulator that is located in an external refrigerant circuit so that refrigerant in the accumulator cools the module.

Radiator fins and a fan, which are used for cooling a power semiconductor module, increase the size of the module. Thus, a compressor that has such a module that is cooled by the outside air occupies a relatively large space.

In the compressor of the publication No. 4-80554, the cooling efficiency of the power semiconductor module, which is attached to the housing circumference, is not considered when determining the location from which refrigerant is drawn into the compressor housing. Therefore, the module is not effectively cooled. The apparatus disclosed in the publication No. 8-14709 requires members to attach a power semiconductor module to an accumulator. Further, since the harness for electrically connecting the module with the compressor is relatively long, it is troublesome to install the harness.

SUMMARY OF THE INVENTION

Accordingly, it is an objective of the present invention to provide a compact and inexpensive electric compressor that effectively cools a power semiconductor unit.

To achieve the above objective, the present invention provides an electric compressor. The electric compressor comprises a compression mechanism and an electric motor. The compression mechanism draws, compresses and discharges refrigerant gas. The electric motor drives the compression mechanism. A housing accommodates the compression mechanism and the electric motor. A power semiconductor module is located in the housing. The power semiconductor module powers the electric motor. A heat sink cools the power semiconductor module. The heat sink is cooled by the refrigerant gas.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 and 2.

Figure 1:
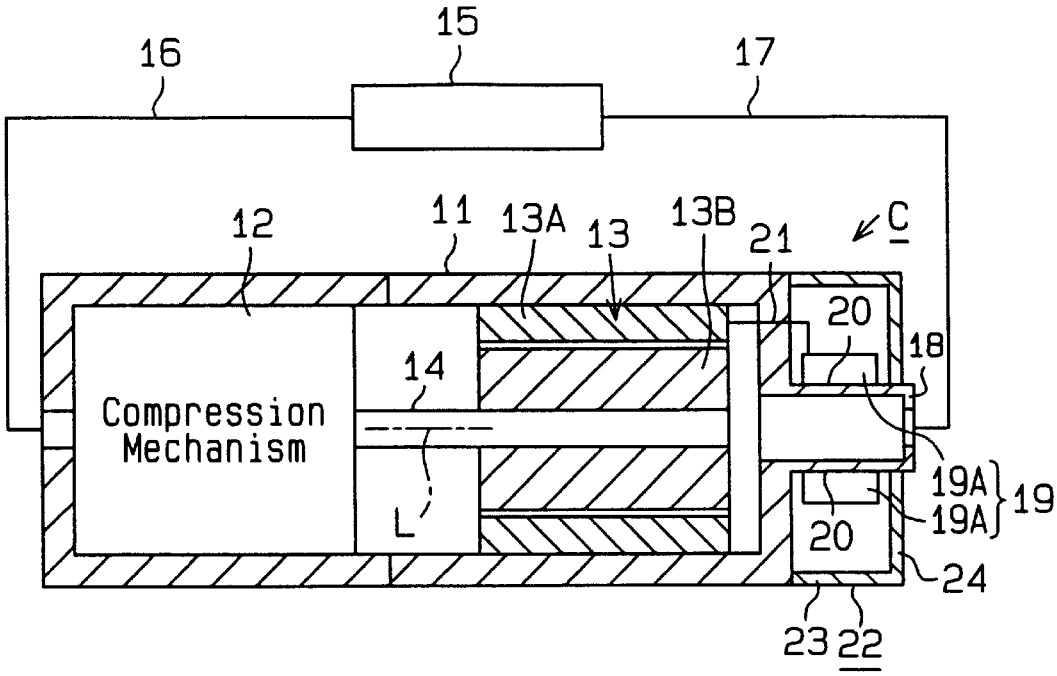
FIG. 1 is a cross-sectional view illustrating an electric compressor according to a first embodiment of the present invention.

As shown in FIG. 1, an electric compressor C includes a substantially cylindrical housing 11. A compression mechanism 12 for compressing refrigerant and an electric motor 13 for driving the compression mechanism 12 are housed in the housing 11. The electric motor 13 has a stator 13A and a rotor 13B. A rotary shaft 14 extends along the longitudinal direction of the housing 11. The rotary shaft 14 couples the compression mechanism 12 to the motor 13 to transmit the force of the motor 13 to the compression mechanism 12.

The compressor C circulates refrigerant in an external refrigerant circuit 15 through a discharge passage 16 and a suction passage 17. The discharge passage 16 connects the compression mechanism 12 with the external refrigerant circuit 15. The suction passage 17 connects the refrigerant circuit 15 with the compression mechanism 12 via the motor 13. In this embodiment, the compressor C, the refrigerant circuit 15, the discharge passage 16 and the suction passage 17 form an air conditioning circuit.

Figure 2:
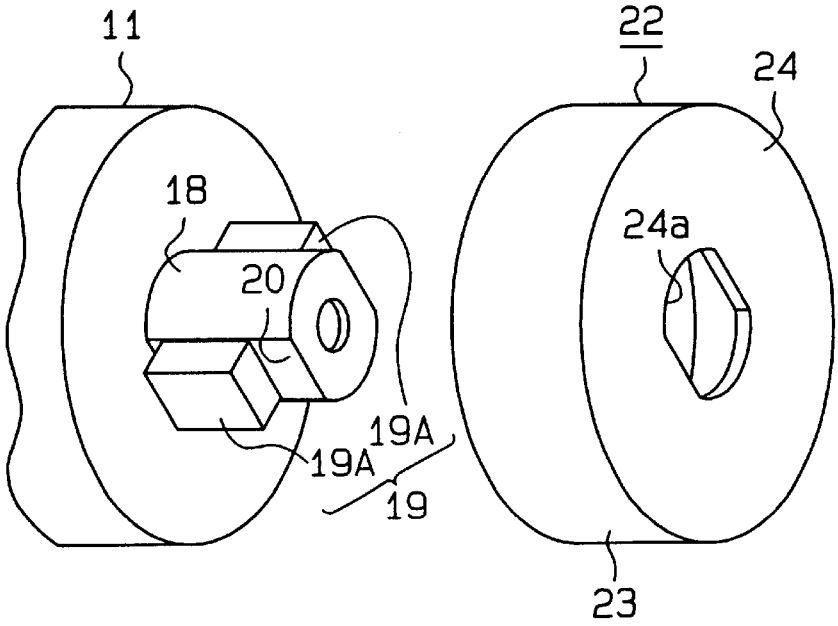
FIG. 2 is a partial perspective view illustrating the compressor shown in FIG. 1.

As shown in FIGS. 1 and 2, a substantially cylindrical heat sink 18 is integrated with an end of the housing 11. The heat sink 18 cools a power semiconductor module, which is an inverter 19 in this embodiment. The inverter 19 has switching elements 19A, the number of which is two in this embodiment. Flat attaching surfaces 20, the number of which is two in this embodiment, are formed on the circumference of the heat sink 18. The switching element 19A are attached to the attaching surfaces 20. The suction passage 17 is communicated with the interior of the housing 11 through the heat sink 18. After being drawn into the housing 11 through the heat sink 18, refrigerant is sent to the compression mechanism 12 through the interior of the motor 13 or through the space between the stator 13A and the rotor 13B. Alternatively, refrigerant may flow through the space between the motor 13 and the inner wall of the housing 11.

The switching elements 19A of the inverter 19 are fixed to the heat sink 18 so that heat is conducted between the heat sink 18 and the switching elements 19A. The inverter 19 supplies electric current to the motor 13 to drive the motor 13.

The heat sink 18 and the inverter 19 are located radially inside of an imaginary cylinder that extends axially from the outer circumference of the housing 11.

The inverter 19 is electrically connected to the motor 13 by a wire harness 21. Current that is required for driving the motor 13 is supplied to the motor 13 through the harness 21.

A part of the heat sink 18 and the inverter 19 is covered by a substantially cylindrical protective cover 22. The protective cover 22 includes an annular portion 23 and a support portion 24. The outer dimension of the annular portion 23 is substantially the same as that of the housing 11. The support portion 24 has a hole 24*a* for receiving the heat sink 18. The shape of the hole 24*a* is substantially the same as that of the heat sink 18.

When receiving current from the inverter 19, the motor 13 rotates and drives the compression mechanism 12, which circulates refrigerant in the air conditioning circuit. At this time, the inverter 19 generates heat. Part of the generated heat is transmitted to the heat sink 18 and is then radiated to the outside air. Another part of the generated heat is also transmitted to the housing 11 and is radiated from the housing 11. Another part of the generated heat is transmitted to the refrigerant flowing through the heat sink 18, which further decreases the heat of the inverter 19.

The embodiment of FIGS. 1 and 2 has the following advantages.

The heat sink 18, to which the inverter 19 is attached, is cooled by refrigerant. This effectively cools the inverter 19. Also, the heat sink 18 increases the area from which the heat generated by the inverter 19 is radiated. The heat is therefore more effectively reduced.

The heat sink 18 not only cools the inverter 19 but also draws refrigerant from the suction passage 17 to the interior of the housing 11. This eliminates the necessity for a member that is used only for cooling the inverter 19. The member prevents the inverter 19 from being exposed to refrigerant.

Since the heat sink 18 is integrated with the housing 11, the heat generated by the inverter 19 is transmitted to the housing 11 via the heat sink 18. That is, the generated heat is radiated from the housing 11, which effectively cools the inverter 19.

When flowing through the heat sink 18, refrigerant is at a stage before being compressed by the compression mechanism 12 and the temperature of the refrigerant is relatively low at the stage. Thus, the refrigerant effectively cools the inverter 19.

The inverter 19 is not located in the external refrigerant circuit 15 but is attached to the housing 11. This structure shortens the wire harness, which connects the inverter 19 with the motor 13, which facilitates the installation of the wire harness 21. Also, no parts for attaching the inverter 19 to the refrigerant circuit 15 are required, which reduces the cost.

The inverter 19 is located in the vicinity of the motor 13, which is housed in the housing 11. Thus, the wire harness 21 is shorter than that of prior art electric compressors. This further reduces the cost.

The inverter 19 and the heat sink 18 is radially inside of an imaginary cylinder that axially extends from the circumference of the housing 11, which reduces the radial size of the compressor C. The compressor C therefore can be fitted in a narrow space.

The inverter 19 is covered by the protective cover 22, which protects the inverter 19 from dust and water. The cover 22 also prevents the inverter 19 from being damaged by contact with other things.

It should be apparent to those skilled in the art that the present invention may be embodied in many other specific forms without departing from the spirit or scope of the invention. Particularly, it should be understood that the invention may be embodied in the following forms.

Figure 3:
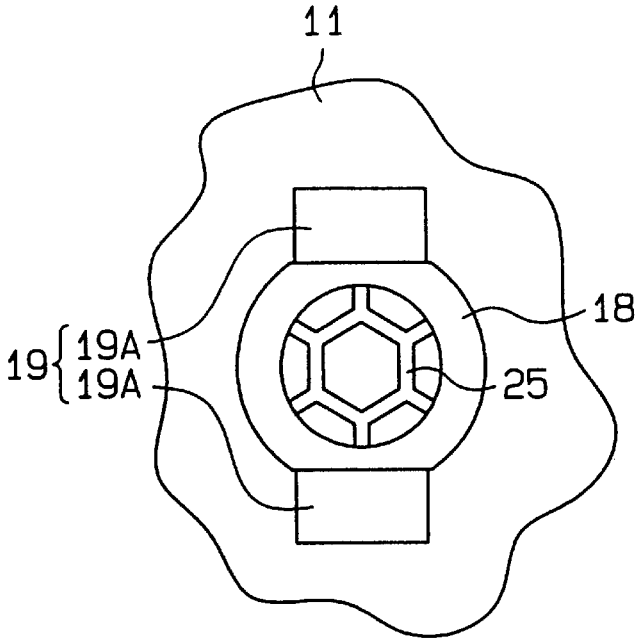
FIG. 3 is an enlarged partial front view illustrating an electric compressor according to a second embodiment of the present invention.

FIG. 3 illustrates a second embodiment of the present invention as viewed from the side from which refrigerant is drawn into the housing 11. In this embodiment, the heat sink 18 has a honey-comb structured radiator fin 25. The fin 25 extends along the longitudinal direction of the heat sink 18. Refrigerant that is drawn into the heat sink 18 from the external refrigerant circuit 15 flows parallel to the fin 25. For visibility, the protective cover 22 is not included in FIG. 3.

The housing 11 of the compressor C may include two or more housing members. For example, the housing 11 of a third embodiment present invention shown in FIG. 4 includes a first housing member llA to house the compression mechanism 12 and the motor 13 and a second housing member l1B that includes a heat sink 26 and houses the inverter 19. Refrigerant flows through the interior of the heat sink 26. The switching elements 19A of the inverter 19 are attached to the outer surface of the heat sink 26 such that heat is transferred between the heat sink 26 and the switching element 19A. The second housing member 11B is located between the first housing member 11A and the suction passage 17. The first housing member 11A of FIG. 4 does not have the heat sink 18 illustrated in FIGS. 1 and 2. Otherwise, the first housing member l1A is the same as the housing 11 of FIG. 1.

Figure 4:
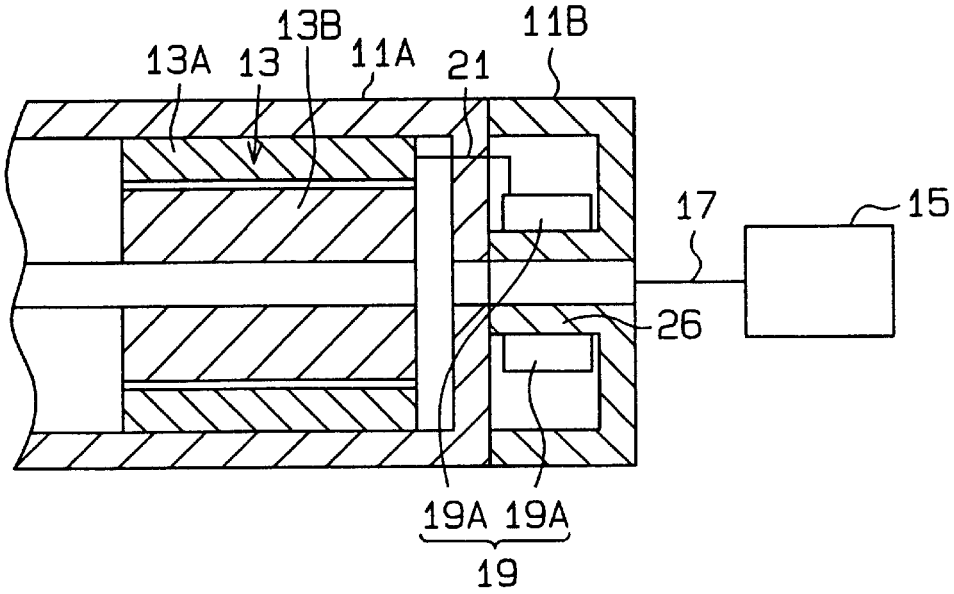
FIG. 4 is an enlarged partial cross-sectional view illustrating an electric compressor according to a third embodiment of the present invention.

Refrigerant flows from the suction passage 17 to the interior of the first housing member 11A through the interior of the heat sink 26. In addition to the advantages of the embodiment of FIGS. 1 and 2, the embodiment of FIG. 4 is advantageous in that the second housing member 11B, which includes the inverter 19, can be assembled in a different set of procedures from that for assembling first housing member 11A. Therefore, the second housing member 11B, which includes an electrical component, or the inverter 19, may be manufactured in a different factory from the factory for manufacturing the first housing member 11A.

The outlet and the inlet of the compressor C may be formed in an end wall of the housing 11 that faces the compression mechanism 12. In this case, the heat sink 18 is located between the inlet and the suction passage 17. The heat sink 18 is formed in the vicinity of the compression mechanism 12. Since refrigerant does not flow through the motor 13, refrigerant does not absorb the heat of the motor 13. Thus, compared to the embodiments of FIGS. 1 to 4, the specific volume of refrigerant is less increased due to an increase of the refrigerant temperature. This improves the compression efficiency.

If the temperature of refrigerant after being compressed by the compression mechanism 12 is lower than the temperature of the inverter 19, the discharged refrigerant may be used for cooling the heat sink 18. In other words, the heat sink 18 may be located on the discharge passage 16. Compared to the embodiments of FIGS. 1 to 4, the specific volume of refrigerant is less increased due to an increase of the refrigerant temperature. This improves the compression efficiency.

The position of the heat sink 18, 26 may be different from or along the embodiments of FIGS. 1 to 4. For example, the heat sink 18, 26 may extend from the circumferential wall of the housing 11. Further, as long as refrigerant flows through the heat sink 18, 26, the heat sink 18, 26 need not be connected to the suction passage 17 or the discharge passage 16. Also, the switching elements 19A of the inverter 19 need not be directly attached to the heat sink as long as the elements 19A are sufficiently close to the heat sink 18, 26 so that heat of the elements 19A is transferred to the heat sink 18, 26. For example, the heat sink 18, 26 may be formed on the inner circumferential wall of the housing 11 and the switching elements 19A may be attached to locations of the outer circumferential wall of the housing 11 that correspond to the heat sink 18, 26.

The cross-sectional shape of the heat sinks 18, 26 need not be circular but may be triangular, rectangular or hexagonal.

The inverter 19 may include three or more switching elements 19A.

The heat sinks 18, 26, which are cylindrical, may be replaced by a heat sink block that has a number of parallel holes. The orientation of the holes are determined such that refrigerant smoothly flows through the holes.

The switching elements 19A of the inverter 19 may be located inside the heat sink 18, 26.

The protective cover 22 may be made of resin or metal. If the cover 22 is made of resin, the weight of the cover 22 is reduced. If the cover 22 is made of metal, the strength of the cover 22 is increased and the cost is reduced. Also, a metal cover effectively prevents static electricity and radio waves generated by the switching elements 19A from escaping.

Therefore, the present examples and embodiments are to be considered as illustrative and not restrictive and the invention is not to be limited to the details given herein, but may be modified within the scope and equivalence of the appended claims.

What is claimed is:

1. An electric compressor comprising:

a compression mechanism for drawing, compressing and discharging refrigerant gas;

an electric motor for driving the compression mechanism;

a housing for accommodating the compression mechanism and the electric motor;

a power semiconductor module located in the housing, wherein the power semiconductor module powers the electric motor; and a heat sink in the interior of housing, said heat sink defining a cooling passage for cooling the power semiconductor module, wherein the heat sink is cooled by the refrigerant gas.

2. The electric compressor according to claim 1, wherein the power semiconductor module and the heat sink are located radially inside of an imaginary surface that extends from an outer surface of the housing in the axial direction of the housing.

3. The electric compressor according to claim 1, wherein the heat sink is formed integrally with the housing.

4. The electric compressor according to claim 1, wherein the power semiconductor module is located in the vicinity of the electric motor.

5. The electric compressor according to claim 1 further comprising a cover for protecting the heat sink and the power semiconductor module.

6. The electric compressor according to claim 1 further comprising a radiator fin located in the heat sink, wherein the radiator fin extends along the axial direction of the heat sink.

7. The electric compressor according to claim 1, wherein the housing has a first housing member and a second housing member, wherein the compression mechanism and the electric motor are located in the first housing member, and wherein the heat sink is located on the first housing member and within the second housing member.

* * * * *